US005944490A

United States Patent [19]

Breslin

[11] Patent Number: 5,944,490

[45] Date of Patent: Aug. 31, 1999

[54] PNEUMATICALLY OPERATED SUBMERSIBLE PUMP WITH FLOAT CONTROL

[76] Inventor: Michael K. Breslin, 1133 Seventh Ave., Oakland, Calif. 94607

[21] Appl. No.: 08/745,476

[22] Filed: Nov. 12, 1996

[51] Int. Cl.[6] ..... F04F 1/06

[52] U.S. Cl. ..... 417/131; 417/134

[58] Field of Search ..... 417/130, 131, 417/134

[56] References Cited

U.S. PATENT DOCUMENTS

| | | | |
|---|---|---|---|
| 484,169 | 10/1892 | Wheeler | 417/131 |
| 1,092,382 | 4/1914 | Ness | 417/131 |
| 1,127,726 | 2/1915 | Buckley . | |
| 1,372,931 | 3/1921 | Brown . | |
| 1,409,476 | 3/1922 | Smythe . | |
| 1,583,461 | 5/1926 | Harvey . | |
| 1,630,971 | 5/1927 | Savage . | |
| 1,687,175 | 10/1928 | Nelson . | |
| 1,721,272 | 7/1929 | Hendricks . | |
| 1,767,452 | 6/1930 | Hewitt . | |
| 1,767,477 | 6/1930 | Rogers et al. . | |
| 2,241,765 | 5/1941 | Chambers | 103/248 |
| 3,972,650 | 8/1976 | Brennan | 417/128 |
| 4,025,237 | 5/1977 | French | 417/131 |
| 4,092,087 | 5/1978 | Anthony | 417/131 |
| 4,395,200 | 7/1983 | Anthony et al. | 417/131 |
| 4,467,831 | 8/1984 | French | 137/625.27 |
| 5,004,405 | 4/1991 | Breslin | 417/131 |
| 5,141,404 | 8/1992 | Newcomer et al. | 417/130 |
| 5,358,037 | 10/1994 | Edwards et al. | 166/105 |
| 5,358,038 | 10/1994 | Edwards et al. | 166/105 |
| 5,487,647 | 1/1996 | Breslin | 417/131 |

FOREIGN PATENT DOCUMENTS

| | | | |
|---|---|---|---|
| 793927 | 2/1936 | France | 417/131 |
| 907397 | 3/1946 | France | 417/131 |

*Primary Examiner*—Charles G. Freay
*Attorney, Agent, or Firm*—Seldon & Scillieri, LLP

[57] ABSTRACT

A submersible pump is disclosed for use in a body of liquid such as a well or sump. The pump has an air intake port and an air outlet port, as well as a liquid intake port and a liquid discharge tube. A valve mounted within the pump selectively permits the pump's chamber to communicate with either the air intake port or the air discharge port. When liquid enters the pump's chamber, the air displaced by the incoming liquid is permitted by the valve to escape via the air outlet port. When the pump's chamber is sufficiently full of liquid, the valve closes off the air outlet port and permits compressed air to enter the pump's chamber via the air inlet port in order to force the accumulated liquid out the liquid discharge tube. A float in the pump's chamber rises and falls with the level of liquid in the chamber to actuate the valve. In one embodiment the valve comprises a movable member mounted for linear reciprocating movement within a valve housing to selectively bring a carried through-passage into fluidic communication with the appropriate air port. In a second embodiment, the valve comprises a movable member mounted for rotating reciprocating movement within a valve housing to selectively bring a carried through-passage into fluidic communication with the appropriate air port.

8 Claims, 3 Drawing Sheets

PNEUMATICALLY OPERATED SUBMERSIBLE PUMP WITH FLOAT CONTROL

FIELD OF THE INVENTION

This invention relates to the pumping of fluids using compressed air or other gas as a power source where the cycling of the pump is controlled by sensing the fluid level within the pump.

BACKGROUND OF THE INVENTION

There are many applications calling for a pumping system which automatically senses the presence of liquid and pumps the liquid from one location to another. Sites containing contaminated ground water, for example, frequently require simple reliable pumps which can fit down a small diameter well. These pumps must be able to withstand corrosive fluids, and are preferably operated pneumatically to avoid the possibility of explosions caused by electrical sparks contacting flammable fluids in the well.

In practice, these pumps are typically suspended vertically within a sump or well, and the compressed air is applied through a valve to the pump's chamber via an appropriate conduit coupled to an air inlet port. Each cycle of the pump's operation comprises an intake phase and an evacuation phase. During the intake phase, liquid within the well enters the pump's chamber through a one-way check valve at the bottom of the pump's housing, displacing the air inside the pump's chamber. The displaced air escapes through an air exhaust conduit as the fluid fills the pump chamber. During the pump's evacuation phase, compressed air is directed into the pump's chamber to force the liquid out via a liquid outlet port.

One such pump is disclosed in my U.S. Pat. 5,004,405 issued Apr. 2, 1991, the contents of which are hereby incorporated by reference. The pump continuously fills and empties itself by means of a float which senses the level of liquid in the pump's chamber. After a sufficient quantity of liquid has entered the chamber, the rising float activates a control valve to allow compressed air into the pump's housing, displacing and discharging the accumulated liquid via the discharge port. As the pump falls with the falling liquid level, it activates the control valve once again to stop the flow of compressed air while opening an air-exhaust port and vent the pump's chamber, permitting more liquid to enter. The pump continues to operate automatically so long as there is sufficient liquid to trip the switch and there is compressed air of sufficient pressure to overcome the head against the pump which is pushing the liquid.

Naturally, compressed gases other than air can be used in these pumps, and it should be understood that the convenient use of the term "compressed air"throughout the specification and claims is meant to include all suitable compressed gases.

One object of the present invention is to provide a pump configuration which can be sent down a smaller diameter bore hole of an oil well, and use less energy, than pumps currently in use in the oil industry. Currently, the oil industry uses a "tip up" pump with sucker rods and a 50 hp motor. These pumps have a grasshopper-like appearance, and are frequently seen dipping up and down in some oil fields in California and elsewhere.

Another object of the invention is to provide a pump which can be easily moved to, installed and serviced at, and removed from a well site.

Another object of the invention is to provide a valve mechanism which switches the pump between its intake and discharge phases which resists swelling, and clogging when the pumped liquid is corrosive or contains debris.

SUMMARY OF THE INVENTION

The present invention is directed to a submersible pump having a simple, highly reliable design which minimizes the number of moving parts and has all of its controls internal to its outer housing.

Briefly, the pump comprises a generally tubular housing having an internal chamber and a liquid-inlet passageway communicating between the chamber and the exterior of the housing. The housing additionally has an air-intake port and an air-exhaust port for respectively permitting the entry and exhaust of air to and from the chamber.

Check valve means are included within the liquid-inlet passageway for permitting entry of the liquid into the chamber, but not the exiting of the liquid from the chamber when the pump is submersed in a liquid.

The pump also includes liquid-discharge conduit means for permitting the accumulated liquid within the chamber to be discharged from the pump.

Control valve means are located within the housing for permitting a selected one of the intake and exhaust ports to communicate with the interior of the housing while substantially preventing the non-selected port from doing so. The control valve means includes a movable valve member for substantially sealing the non-selected port from the interior of the housing. The valve member carries one or more through-passageways positioned by the movement of the valve element to provide fluid communication between the selected port and the chamber.

The pump also includes means for actuating the control valve in response to the level of liquid in the pump's chamber. The actuating means includes a float within the chamber that rises and falls with the liquid level, and control rod means positioned for contact by the float near the float's upper and lower limits of travel to move the valve element in response to the liquid level's falling to a lower level within the chamber so that the air-exhaust port communicates with the pump's chamber, and to move the valve element in response to the liquid's rising to an upper level within the chamber so that the air-inlet port communicates with the pump's chamber.

These and other details concerning my invention will be appreciated from the following detailed description of the preferred embodiment, of which the drawing forms a part.

DETAILED DESCRIPTION OF THE DRAWINGS

FIG. 1 is a longitudinal sectional view in schematic of a submersible pump constructed in accordance with the invention, showing the pump at the beginning of its discharge phase;

FIG. 1A is a sectional view taken along line A—A of FIG. 1, showing the preferred manner for coupling the arm 34 to the rod 30 with pin 36.

DETAILED DESCRIPTION OF THE PREFERRED EMBODIMENT

Figure 1:
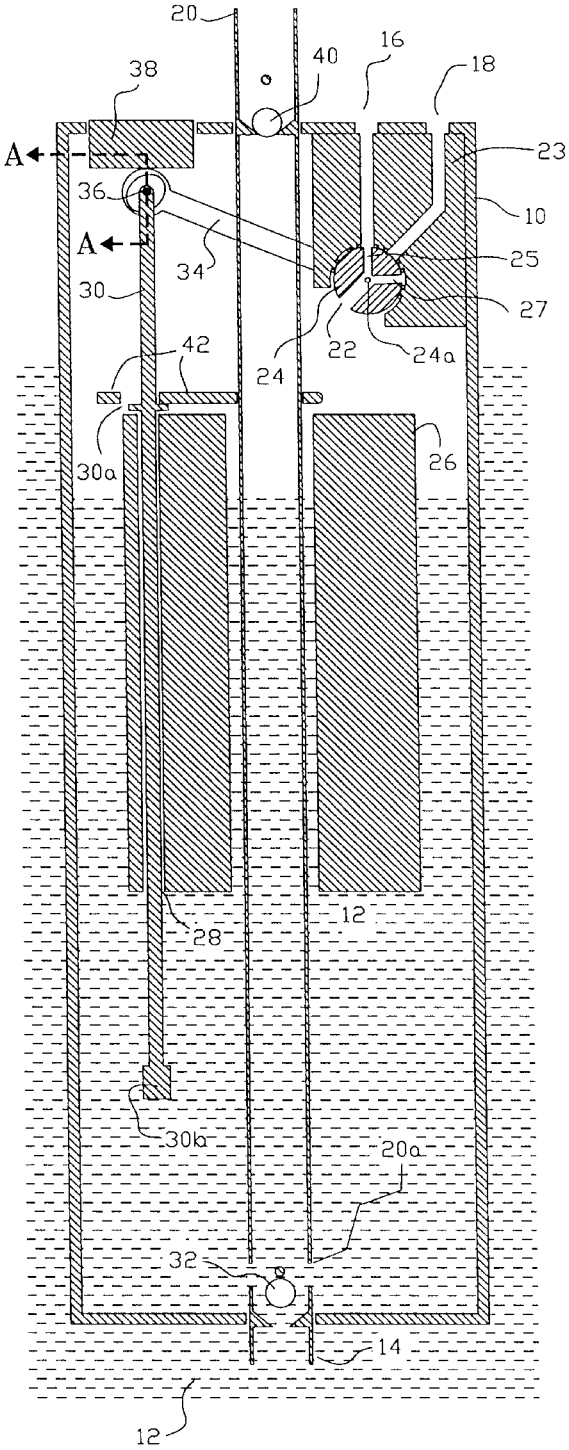
Figure 2:
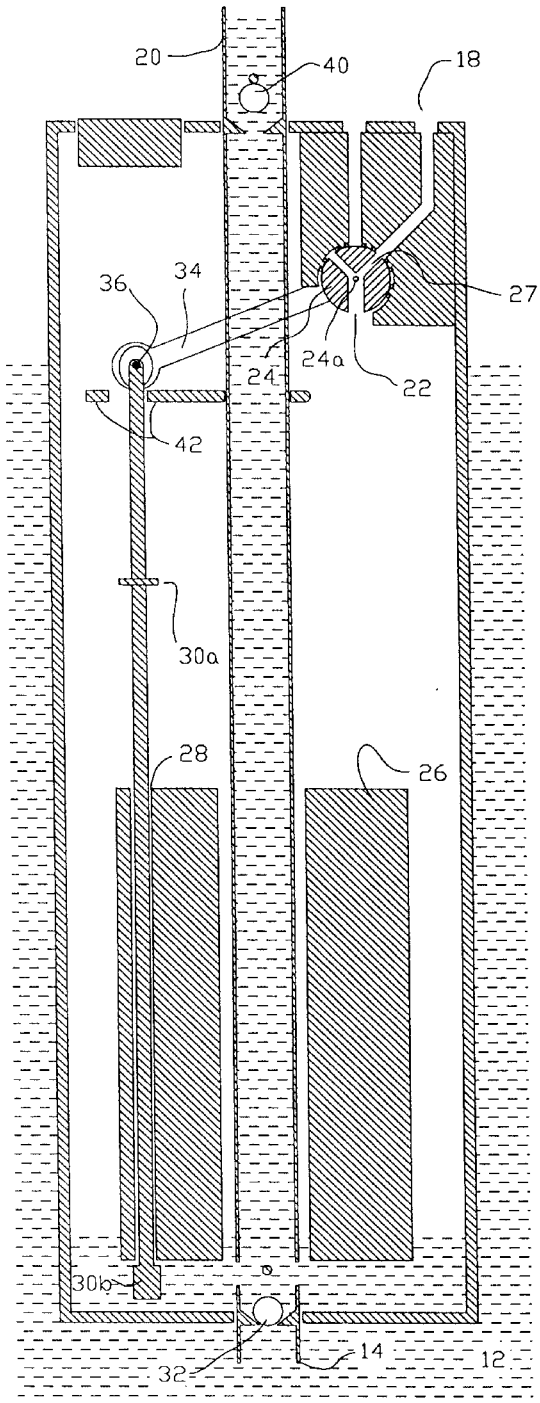
FIG. 2 is a longitudinal sectional view in schematic of the submersible pump of FIG. 1, showing the pump at the beginning of its intake phase.

FIGS. 1 and 2 are respectively longitudinal section views in schematic of a submersible pump constructed in accordance with the invention. The illustrated pump operates in cycles, with each cycle comprising an intake phase and a discharge phase. During the intake phase, the liquid in which the pump is immersed is permitted to enter the pump. During the discharge phase, the liquid within the pump is discharged from the pump.

FIG. 1 depicts the pump at the beginning of its discharge phase, when its chamber is substantially filled with the liquid to be discharged. FIG. 2 depicts the pump at the beginning of its intake phase, after the liquid has been substantially discharged from the chamber and the pump is about to permit the entry of additional liquid.

Referring initially to FIG. 1, the pump comprises a generally tubular outer housing 10 having an interior chamber. The housing 10 is depicted as having been lowered into a well or sump, and is accordingly shown submerged in a body of liquid 12.

A liquid-inlet passageway 14 in the bottom of the housing 10 permits the entry of liquid 12 into the pump chamber during the pump's intake phase. A check valve, schematically illustrated by its check ball 32, is positioned in the inlet passageway 14 to prevent the liquid 12 from escaping via the liquid-inlet passageway 14 during the pump's discharge phase.

The housing 10 additionally includes an air inlet port 16 and an air exhaust port 18 which selectively communicate with the chamber via valve means 22. Valve means 22 comprises a generally cylindrical valve member 24 mounted for rotation within a valve housing 23 about an axis 24*a*. The valve member 24 is preferably made of chrome steel for its hardness and non-corrosiveness. The valve housing is preferably made from Teflon® or similar material which provides a low-friction sealing surface against the valve member 24.

The valve member 24 carries a pair of through-passageways 25, 27, one of which being brought into alignment with a selected one of the air ports 16, 18 when the valve member 24 is suitably rotated. The aligned passageway couples the selected port to the pump's chamber, while the non-selected port is sealed from the pump's chamber by the body of the valve member 24. As illustrated in FIG. 1, the through-passageways 25, 27 are preferably bored to form a "Y"-shape in the valve member 24, enabling the two passageways to share a common segment.

In FIG. 1, the pump has been substantially filled with liquid 12 during its previous intake phase, and is beginning its discharge phase. The valve member 24 has accordingly been rotated into a position which aligns passageway 25 with the air inlet port 16, coupling that port to the pump's chamber. In operation, the air inlet port 16 is coupled to a source of compressed air or other suitable gas (not shown) by suitable conduit means (not shown). The pressure of the compressed air is greater than that of the liquid within the pump's chamber. Accordingly, the compressed air entering the pump's chamber through passageway 25 of valve member 24 forces the check ball 32 to seal off the liquid intake port 14. As it is displaced by the incoming compressed air, the liquid 12 within the chamber is consequentially forced out of the chamber via a discharge tube 20 which extends from the chamber's interior to the exterior of the pump's housing 10. In practice, the discharge tube is coupled to a conduit (not shown) at the exterior of the pump's housing 10 which conducts the discharged liquid out of the well.

Figure 1A:
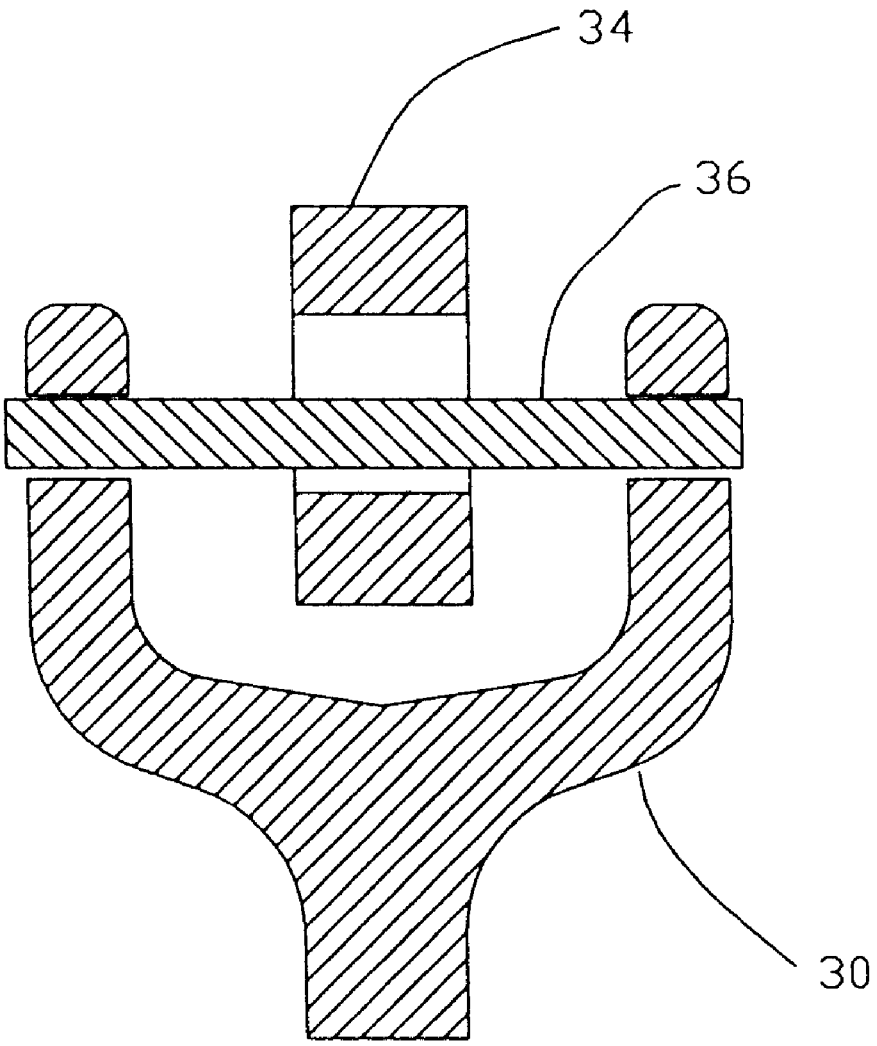

As the liquid level in the pump's chamber decreases, a float 26 within the pump's chamber falls with it. The float 26 is generally cylindrical in shape with a generally annular cross-section that permits the float 26 to be mounted about the discharge tube 20 and to freely slide up and down the tube 20 in response to the liquid level within the chamber. The float 26 conveniently includes a peripheral rod-accommodating through-passage 28 which extends in a direction parallel to the float's longitudinal axis. A control rod 30 extends through the passage 28, and is coupled at one end by a pin 36 to an actuating arm 34 of the valve element 24. FIG. 1A is a sectional view taken along line A—A of FIG. 1, showing the preferred manner for coupling the arm 34 tot he rod 30 with pin 36. The other end of the control rod 30 extends to a point below the bottom of the float 26. The control rod 30 is dimensioned so that the float 26 freely passes up and down between upper and lower engagement surfaces 30*a*, 30*b* respectively formed on the control rod 30.

The two engagement surfaces 30*a*, 30*b* are conveniently formed by rod surfaces having cross-sectional dimensions too large to fit into the passageway 28. The control rod 30 is thereby moved by the float's engagement of the surfaces 30*a*, 30*b* to move actuating arm 34 of the valve member 24.

As the liquid 12 is discharged from the pump, the level of the float 26 falls until it contacts the lower engagement surface 30*b*, which is positioned on the control rod 30 to ensure that an appropriate quantity of liquid 12 has been evacuated from the pump's chamber via the discharge tube 20 at the time of engagement. As the accumulated liquid continues to be forced out of the pump's chamber by the in-rushing compressed air, more and more of the float is exposed above the declining level of the fluid until the weight of the float is sufficient to pull the control rod 30 downward. The downward movement of the control rod, in turn, causes a counter-clockwise rotation of the valve member 24 which stops when the valve arm 34 contacts a lower valve arm stop 42.

As illustrated in FIG. 2, the counter-clockwise rotation of the valve member 24 seals the air inlet port 16 from the pump's chamber, and aligns the valve's passageway 27 with the air exhaust port 18, placing the port 18 in fluidic communication with the pump's chamber and starting the pump's intake phase.

In operation, the air exhaust port 18 is coupled to a conduit (not shown) which extends to the surface of the well, or to some other region at an ambient pressure lower than that of the liquid entering the pump. With the pump's chamber exhausted to the relatively lower pressure, check ball 32 is pushed away from the liquid inlet port 14 by the relatively higher pressure liquid 12, permitting the liquid 12 to enter the pump's chamber and displace the remaining air out the air exhaust port 18 via passageway 27 in valve member 24.

As the fluid 12 enters the pump's chamber via the liquid-inlet passageway 14, the float 26 is buoyed by the fluid and rises until its the upper end contacts the upper contact surface 30*a* of the control rod 28. The upward force exerted by the float 26 against the contact surface 30*a* moves the control rod 30 upward, rotating the valve element 24 clockwise from its position depicted in FIG. 2 back to its position depicted in FIG. 1, completing the pump's cycle. The upper limit of travel for the control rod 30 is established by an upper stop 38 within the pump housing that is contacted by the upwardly moving valve arm 34.

The pump described in this specification is believed to be superior to those in the prior art which use poppet valves.

First, the subject pump can operate at higher pressures than those which use poppet valves to switch between the intake and discharge phases of operation because the operation of poppet valves requires opposing air pressure to be overcome. Since the air pressure must be sufficiently large to force the liquid from the pump chamber during the discharge phase, the poppet valves must be subjected to larger opposing pressures as liquid pressure increases with depth and density.

Moreover, poppet valves that are constructed from elastomeric material can be dissolved by corrosive liquids, and are subject to swelling at high pressure. Both of these phenomenon are a source of seal failure.

The subject pump additionally operates without the use of bleeder holes in the air valve. Bleeder holes reduce a pump's efficiency owing to their constant leakage of compressed air. In addition, bleeder holes in the pump's air valve are susceptible to clogging when debris or oil is present in the compressed air line. Clogging of the bleeder hole freezes the pump in the discharge phase or the intake phase, depending on the valve's configuration, rendering the pump inoperable.

Figure 3:
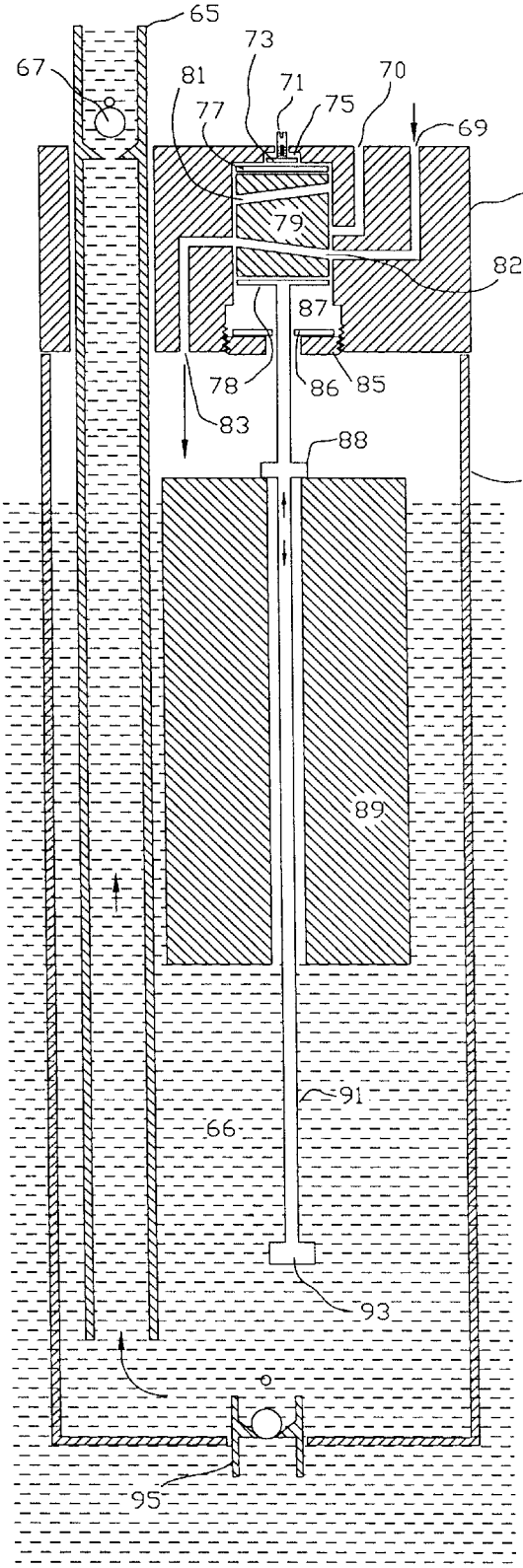
FIG. 3 is a longitudinal sectional view in schematic of an alternative embodiment of a submersible pump constructed in accordance with the invention, showing the pump at the beginning of its discharge phase.
Figure 4:
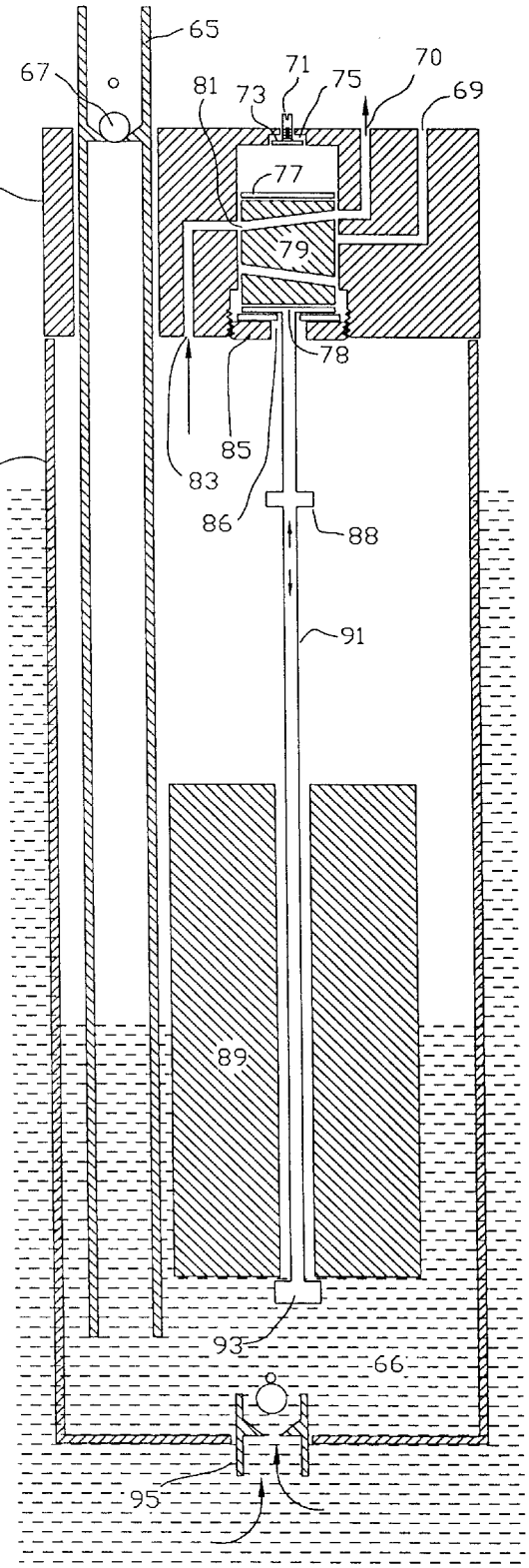
FIG. 4 is a longitudinal sectional view in schematic of the submersible pump of FIG. 3, showing the pump at the beginning of its intake phase.

FIGS. 3 and 4 illustrate an alternative embodiment of the invention, wherein the rotating valve member 24 has been replaced by a reciprocally movable member 79. As also shown in FIGS. 3 and 4, the pump can be configured to permit the float 89 to rise and fall about the control rod 91, rather than the discharge tube as in the previous embodiment, and the discharge tube 67 can be spaced away from the float, rather than passing through the float. Naturally, both the control rod and the discharge tube can be spaced from the float if desired; however, the resulting configuration uses space less efficiently and requires another structure to guide the float's movement.

Turning initially to FIG. 3, which schematically depicts a longitudinal sectional view of the pump at the beginning of its discharge phase, a generally cylindrical or cubical valve member 79 carries a pair of spaced-apart through-passages 77, 82 which extend generally perpendicular to the member's longitudinal axis. The member 79 slides reciprocally in the axial direction, carrying the through-passages to positions which complete either the path from the air intake port to the chamber or the path from the air exhaust port to the chamber while the body of the valve element 79 blocks the non-completed path.

When the float 89 contacts the upper stop 88 of the control rod, it pushes the valve member 79 upward, moving it into a position where the through-passage 82 fluidically couples the input port 69 to the pump's cavity, permitting compressed air to enter the chamber and force the accumulated liquid out of the discharge tube 65.

As illustrated in FIG. 4, which schematically depicts a longitudinal sectional view of the pump at the beginning of its intake phase, the declining level of liquid in the pump's cavity during discharge causes the float 89 to contact the lower control rod stop 93. As the fluid level decreases and exposes more and more of the float, the float's weight becomes less offset by its buoyancy; the additional unbuoyed weight ultimately causes the control rod 91 to pull the valve member 79 downward, aligning passageway 77 in such a way as to place the discharge port 70 in fluidic communication with the pump's cavity.

The valve member 79 can be held in its upper and lower position with magnets to produce a forceful and rapid switching at the appropriate time. Accordingly, the valve member 79 is held in place at its uppermost position by an upper magnet 73, which attracts a magnetically responsive plate 77 attached to the uppermost extremity of the valve member 79. The magnetic force holding the valve member 79 in its uppermost position can be adjusted via a screw 71 which is threaded through the upper extremity of the upper head 63. By turning the screw 71, the upper magnet 73 can be drawn up and away from the magnetically responsive plate 77 into a recess 75 in the upper head 63, or down and towards the plate 77 thereby varying the magnetic force exerted on the plate.

In its lowermost position, the valve member 79 is held in position by a lower magnet 85 which is attracted to a second magnetic plate 78 on the lowermost extremity of the valve member 79. The lower magnet 85 can also serve as a lower stop for the valve member 79 so the air passages 81 lines up with the air passages 70, 83 in the upper head 63.

The magnetic attraction between the lower magnet 85 and the valve member 79 can be adjusted by placing a non-magnetic material 86, such as a brass or urethane washer, of desired thickness on the lower magnet 85. By selecting a particular thickness, one can control the distance between the magnetically responsive plate 78 and the lower magnet 85 when the valve member 79 is in its lowermost position, thereby determining the amount of magnetic force which the lower magnet 85 exerts on the magnetically responsive plate 78.

The position of the lower magnet 85 relative to the upper head 63 can also be adjusted. In FIGS. 3 and 4, for example, the lower magnet 85 is externally threaded, and the bore 87 which houses and holds the valve member 79 is internally threaded to mate with the lower magnet. Turning the magnet 85 accordingly threads it up into the upper head 63, or down out of the upper head 63 to adjust the position of the valve member 79.

In operation, the upper magnet 73 holds the valve member 79 in its uppermost position while the liquid is driven out of the pump through an upper check valve 67 by the compressed air. When the pump is sufficiently emptied of fluid, the float 89 contacts the lower control rod stop 93, which is fixed to the control rod 91. Since the upper magnet 73 is holding the sliding valve 79, and the control rod 91 in the upper position, the float 89 must push against the lower stop 93 with sufficient force to break the sliding valve 79 free from the magnetic field of the upper magnet 73.

As the liquid continues to be pushed from the pump by the compressed air, additional buoyancy is taken from the float 89, causing it to push harder and harder against the lower stop 93 until the force is sufficient to overcome the magnetic force holding the valve 79 in its uppermost position. The valve 79 then shifts to its lowermost position to exhaust the compressed air from the pump.

After the valve member 79 has dropped down to its lower position, air is exhausted from the pump's chamber so that liquid can enter. The rising liquid level causes the float 89 to rise against the upper control rod stop 88 with sufficient force to push the sliding valve member 79 away from the lower magnet 85, causing the valve member to shift to its upper position, where it is again held in place by the upper magnet 73. This cycle repeats as long as there is fluid 66 to fill the pump and Naturally, the value member 79 can itself be a pernament 20 magnet, with structures 73 and 85 being formed from magnetically responsive material instead. Further, a similar arrangement of magnets can be used with the embodiment of FIGS. 1 and 2, with the arm 34 of the valve means 24 being either a magnet or magnetic, and the structures 38 and 42 being magnetic or magnets, respectively.

While the foregoing descriptions includes details which will enable those skilled in the art to practice the invention, it should be recognized that the descriptions are illustrative in nature and that many modifications and variations will be apparent to those skilled in the art having the benefit of these teachings. It is accordingly intended that the invention herein be defined solely by the claims appended hereto and that the claims be interpreted as broadly as permitted in light of the prior art.

I claim:

1. A submersible pump comprising:

a generally tubular housing having a chamber, liquid-inlet passageway communicating between the chamber and the exterior of the housing, an air intake port and an air exhaust port;

valve means within the housing for permitting a selected one of the air intake and air exhaust ports to communicate with the interior of the housing while substantially preventing the non-selected port from doing so, the valve means including a movable valve member for sealing the non-selected port from the interior of the housing, the valve member carrying at least one through-passageway formed in its body for a positioning by said movement that provides fluid communication between a selected port and the interior of the housing through the passageway;

check valve means within the liquid-inlet passageway for permitting entry into the housing, but not egress from the housing, of the liquid in which the housing is submerged;

a float within the housing which is buoyant in the liquid, the float being positioned to fall and rise between highest and lowest positions with the level of incoming liquid, the lowest position being sufficiently high to leave the float at least partially unbuoyed by the liquid near the completion of discharge;

discharge tube means having a proximal end in fluid communication with the housing's interior, and a distal end in fluidic communication with the exterior of the housing for conducting discharged liquid from within the housing;

control rod means coupled to the valve member, the control rod means being responsive to at least the partially unbuoyed weight of the float at the float's lowest position to move the valve element to a first valve position which fluidically couples the pump's chamber to the air exhaust port, whereby air within the chamber can be pushed out the air exhaust port by liquid entering the chamber through the liquid inlet port, the control rod means being further responsive to the float's rising to its highest position to move the valve element to a second valve position which fluidically couples the air inlet port to the pump's chamber, whereby compressed gas from an external source can enter the chamber via the air inlet port to force accumulated liquid from the chamber out via the discharge tube means, magnetic means for detaining the valve element at least one of the first and second positions until sufficient force is generated by the float to produce a rapid switching between one of said positions and the other wherein the float includes an axially-extending rod-accommodating through-passage, and the control rod means includes an axially movable, axially extending rod sized to pass through the rod-accommodating passage of the float, and means for coupling the valve member for responsive movement with the rod, the rod having a first contact surface engagable by the float near the float's lowest position so that the increasing unbuoyed weight of the float causes movement of the valve member to its first valve position, the rod having a second contact surface engagable by the float near the float's highest position so that the force of the rising float causes movement of the valve member to its second valve position.

2. The submersible pump of claim 1 further including an upper stop surface positioned to establish an upper limit of travel for the control rod.

3. The submersible pump of claim 2 wherein at least a portion of the upper stop surface is a magnet.

4. The submersible pump of claim 3 wherein the coupling means is magnetically coupled to the upper stop surface when the float is at its highest position.

5. The submersible pump of claim 3 wherein the control rod is magnetically coupled to the upper stop surface when the float is at its highest position.

6. The submersible pump of claim 1 further including a lower stop surface positioned to establish an low limit of travel for the control rod.

7. The submersible pump of claim 6 wherein at least a portion of the lower stop surface is a magnet.

8. The submersible pump of claim 7 wherein the coupling means is magnetically coupled to the lower stop surface when the float is at its lowest position.

* * * * *